US006638113B2

(12) United States Patent
Kajiwara et al.

(10) Patent No.: US 6,638,113 B2
(45) Date of Patent: Oct. 28, 2003

(54) PIN CONFIGURATION ADAPTER FOR AC-ADAPTER

(75) Inventors: Terutomo Kajiwara, Iizuka (JP); Takenori Kinkawa, Iizuka (JP); Hidetoshi Hamai, Iizuka (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 10/011,054

(22) Filed: Dec. 6, 2001

(65) Prior Publication Data

US 2002/0081906 A1 Jun. 27, 2002

(30) Foreign Application Priority Data

Dec. 22, 2000 (JP) ..... 2000-391427

(51) Int. Cl.[7] ..... H01R 33/94
(52) U.S. Cl. ..... 439/651; 439/131; 439/956
(58) Field of Search ..... 439/651, 131, 439/172–174, 956; 363/144–146

(56) References Cited

U.S. PATENT DOCUMENTS 4,973,827 A * 11/1990 Nozaki ..... 219/521
5,613,863 A * 3/1997 Klaus et al. ..... 439/131
5,702,259 A * 12/1997 Lee ..... 439/137
5,973,948 A * 10/1999 Hahn et al. ..... 363/146
6,261,109 B1 * 7/2001 Liu et al. ..... 439/131

FOREIGN PATENT DOCUMENTS

JP 1224717 8/1999

* cited by examiner

*Primary Examiner*—Hien Vu
(74) *Attorney, Agent, or Firm*—Ladas & Parry

(57) ABSTRACT

A pin configuration adapter is disclosed which can be attached to an AC-adapter having a plug body having a first pin configuration and an AC-adapter housing having a power conversion circuit. The plug body is rotatable between a first position where it is accommodated in a recess formed in the AC-adapter housing and a second position where it is in an upright position with respect to the AC-adapter housing. The pin configuration adapter includes a plug part having a second pin configuration different from the first pin configuration; a receptacle part whereto the plug body in the second position can be inserted; a pin configuration adapter housing having an internal connection mechanism for electrically connecting the plug body and the plug part; and an engaging part provided on the pin configuration adapter housing and engages with the recess of the AC-adapter housing.

4 Claims, 8 Drawing Sheets

PIN CONFIGURATION ADAPTER FOR AC-ADAPTER

BACKGROUND OF THE INVENTION

1. Field of the Invention

The present invention relates to a pin configuration adapter for an AC-adapter, and particularly relates to a pin configuration adapter having a different pin type from that of the AC-adapter and which is, in use, attached to the AC-adapter.

2. Description of the Related Art

Generally, a power transformer (AC-adapter) is widely used for supplying power to portable electronic devices and/or for recharging batteries of such electronic devices. The power transformer includes a housing, a plug protruding from the housing, a conversion circuit provided inside the housing and an output cord extending from the housing. In order to plug the power adapter to the power socket, the pins are inserted into the power socket. In the converting circuit, an alternating current supplied from the power socket is converted to a direct current of a predetermined voltage. The obtained direct current is output from the output cord which may be connected to an electronic device.

Recently, many people bring such devices abroad on their private or business trips. However, there is no global standard configuration for a power socket, and therefore there are various configuration of the power socket for various countries.

Accordingly, an AC-adapter having a parallel-blade pin configuration conforming to a standard adopted in countries such as Japan, Taiwan and the US, cannot be used in those countries where power sockets are configured to match a pin configuration different from the parallel-blade type. Therefore, the traveller wishing to travel in such a country had to purchase and bring AC-adapters conforming to pin configurations adopted in the country or countries he wishes to travel in.

However, it is troublesome to prepare AC-adapters of different pin configurations conforming to the domestic standard and to foreign standards. Also, since each of the AC-adapters has a conversion circuit therein, it is comparatively expensive to prepare different types of AC-adaptors. Therefore, it is an economic burden to a user of a portable electronic device to prepare expensive AC-adapters for each standard with different pin configuration.

In order to overcome the above-mentioned problem, it is known to provide pin configuration adapters having a pin configuration different from that of the plug provided on the housing, which may be attached to the AC-adapter. However, the pin configuration adapter of the related art is attached the AC-adapter by simply inserting the pins of the AC-adapter to the pin configuration adapter and therefore an attachment force to the AC-adapter is weak. Therefore, there is a problem that the pin configuration adapter may fall off from the AC-adapter upon insertion to the power socket.

SUMMARY OF THE INVENTION

Accordingly, it is a general object of the present invention to provide a pin configuration adapter for an AC-adaptor which can solve the above problems.

It is another and more specific object of the present invention to provide a pin configuration adapter for an AC-adaptor which can be securely plugged to the AC-adaptor having a plug body having a first pin configuration and an AC-adapter housing having a conversion circuit for converting an electric power supplied via the plug body, the plug body being rotatable between a first position in which the plug body is accommodated in a recess formed in the AC-adapter housing and a second position in which the plug body is in an upright position with respect to the AC-adapter housing.

In order to achieve the above objects, a pin configuration adapter includes:

- a plug part having a second pin configuration different from said first pin configuration;
- a receptacle part whereto said plug body in said second position can be inserted;
- a pin configuration adapter housing having an internal connection mechanism for electrically connecting said plug body and said plug part; and
- an engaging part provided on said pin configuration adapter housing and engages with said recess of said AC-adapter housing.

With the pin configuration adapter described above, when the pin configuration adapter is attached to the AC-adapter, the pin provided on the plug body are inserted into the pin configuration adapter housing and the recess of the pin configuration. Also, the engaging part provided on the pin configuration adapter housing engages with the recess of the AC-adapter housing. In this attached state, the pins of the plug body and the pins of the plug part are connected by a connection mechanism. Thus, the AC-adapter can be attached to a power socket having a configuration matching the pin configuration of the plug part.

With such a structure, the pin configuration adapter is attached to the AC-adapter by two forces: an engagement force between the plug body and the pin configuration adapter housing (in detail, the connection mechanism) and an engagement force between the engaging part and the recess. Thus, since the pin configuration adapter is attached to the AC-adapter by two engagement forces, the pin configuration adapter can be securely attached to the AC-adapter.

Also, the engaging part engages with the recess formed on the AC-adapter which is a portion where the plug body is accommodated and where a space is formed when the plug body moves to the second position (when the AC-adapter is in use). The pin configuration adapter is attached to the AC-adapter when the plug body is in the second position, and therefore the engagement part engages with the space formed after the plug body has been moved.

That is to say, since the engaging part matches with the recess provided in the AC-adapter, even in a state where the engaging part is engaged with the recess of the AC-adapter, the size of the AC-adapter is kept considerably compact. Also, even when the pin configuration adapter 20is attached to the AC-adapter, the portableness of the AC-adapter is maintained.

DETAILED DESCRIPTION OF THE PREFERRED EMBODIMENTS

In the following, principles and embodiments of the present invention will be described with reference to the accompanying drawings.

Figure 1:
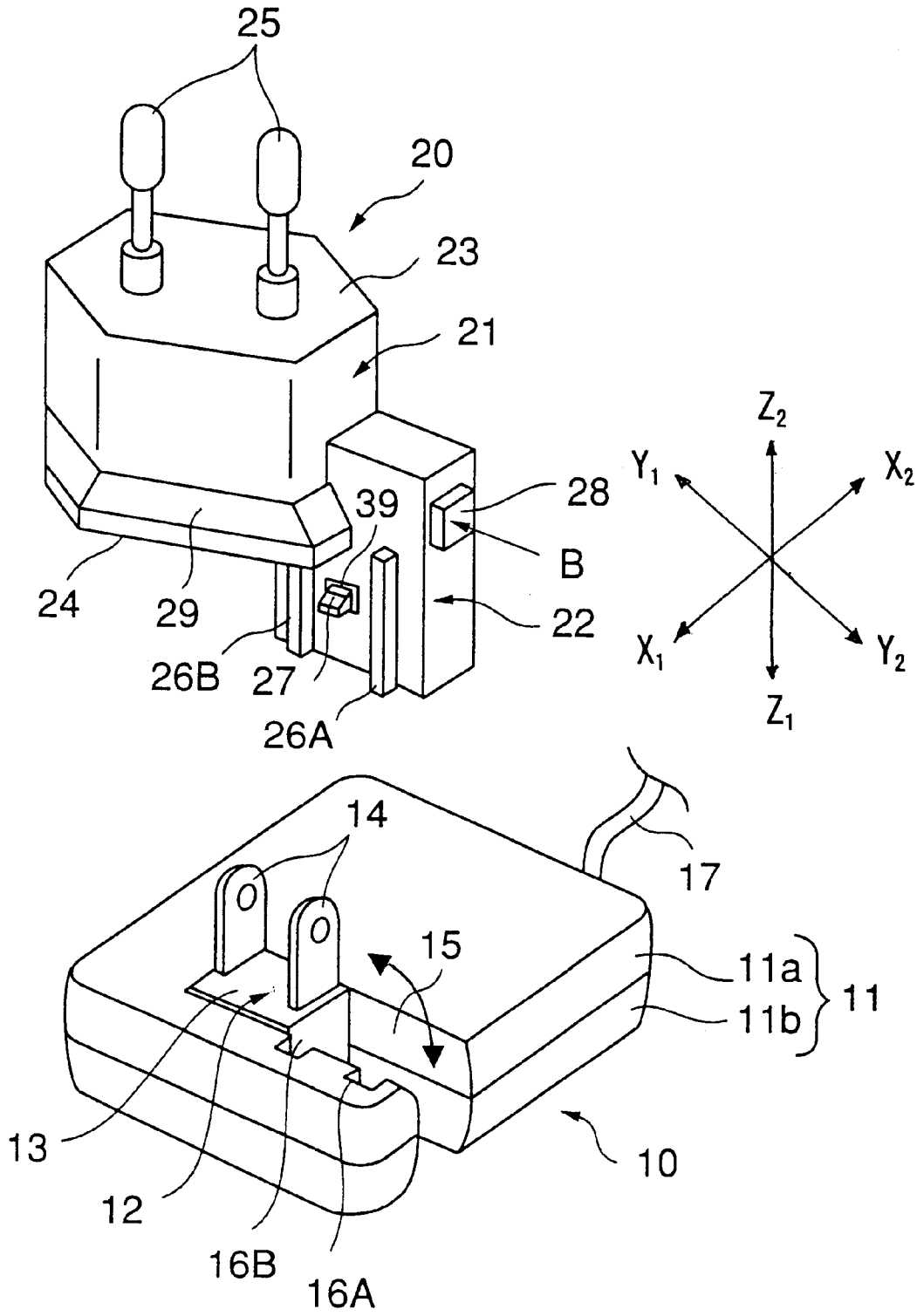
FIG. 1 is a perspective diagram showing how a pin configuration adapter of an embodiment of the present invention is attached to an AC-adapter.
Figure 4A:
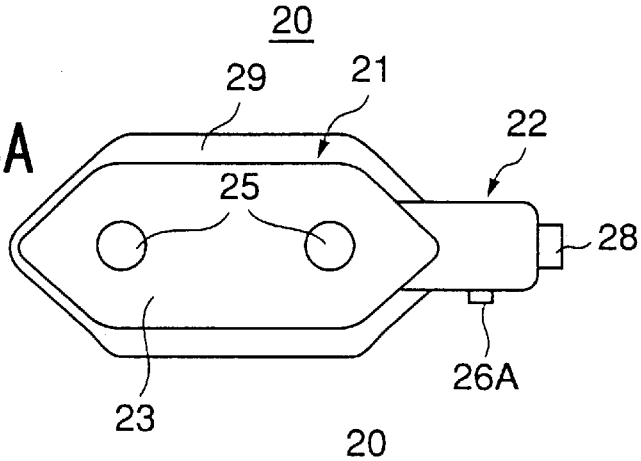
FIGS. 4A to 4D are a plan view, a front view, a bottom view and a side view, respectively, of a pin configuration adapter of the first embodiment of the embodiment of the present invention.
Figure 4D:
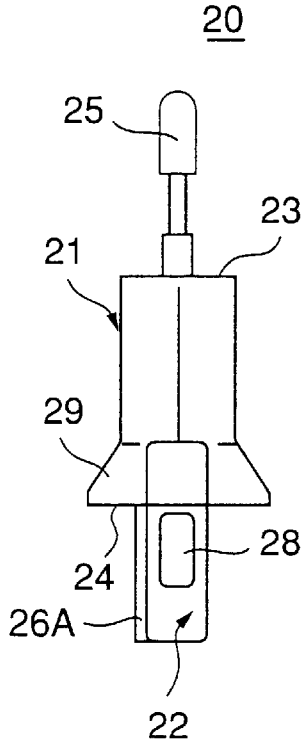
Figure 4B:
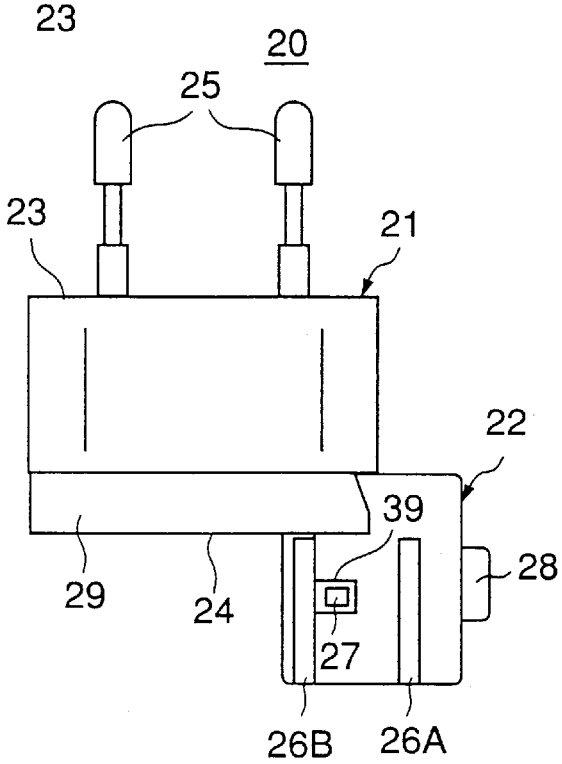
Figure 4C:
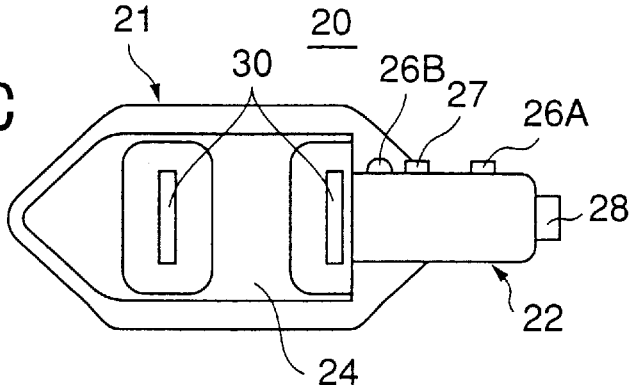
Figure 5:
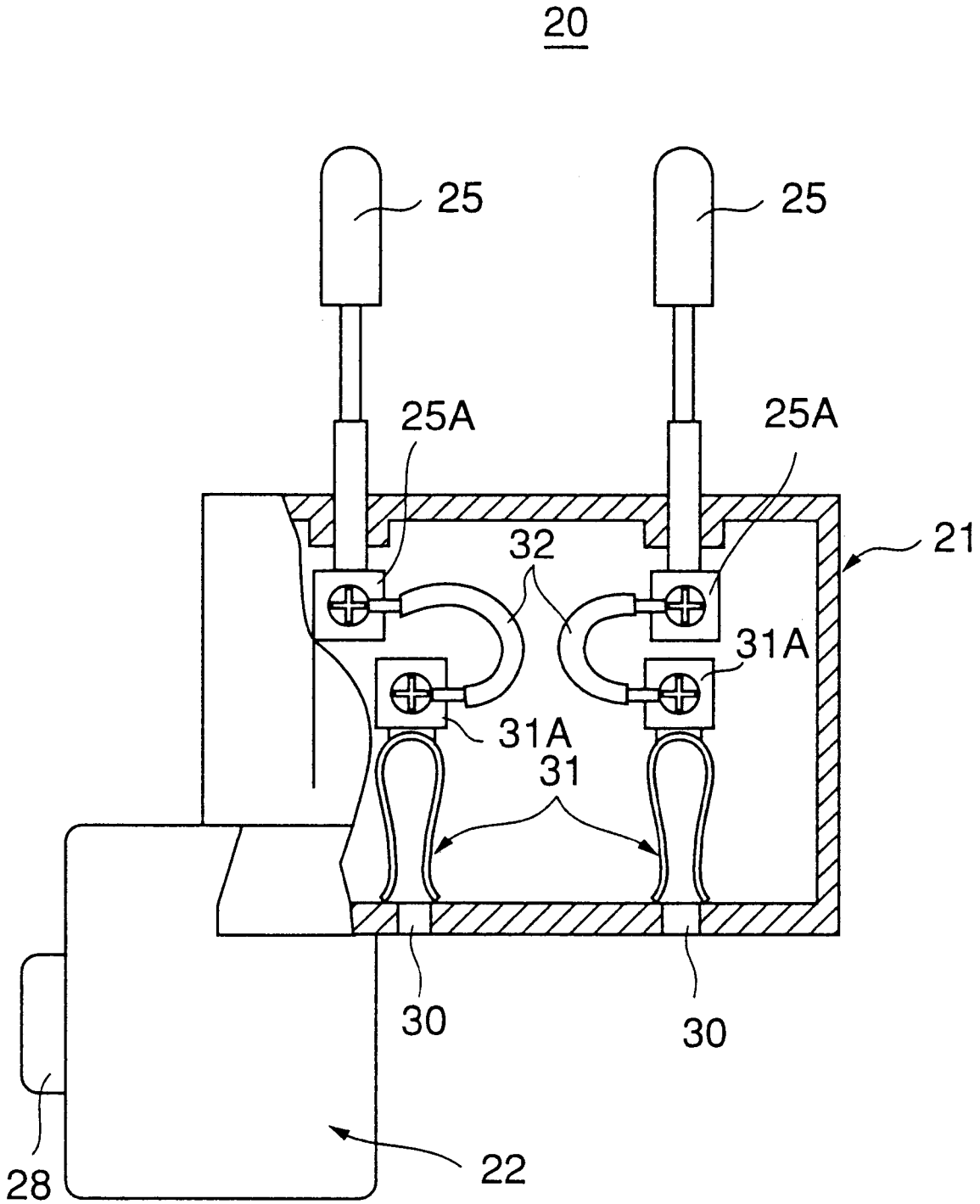
FIG. 5 is a partial sectional diagram showing an internal structure of the pin configuration adapter of the embodiment of the present invention.
Figure 6:
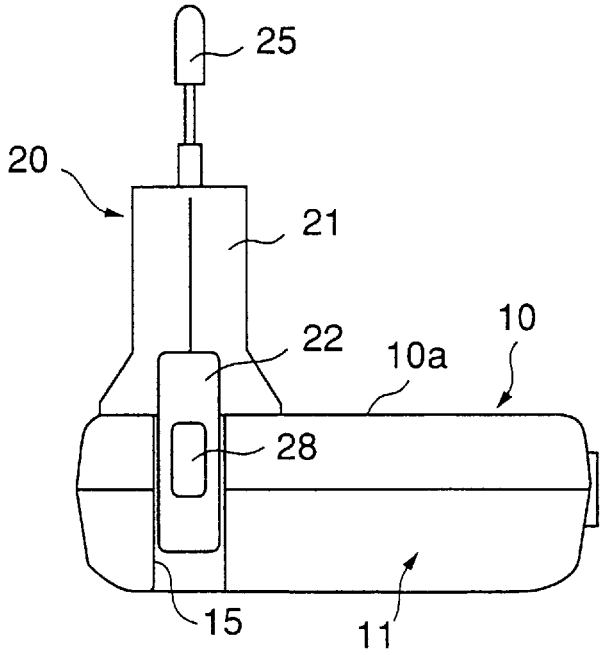
FIG. 6 is a front view showing a state where the pin configuration adapter of the present invention is attached to the AC-adapter.
Figure 7:
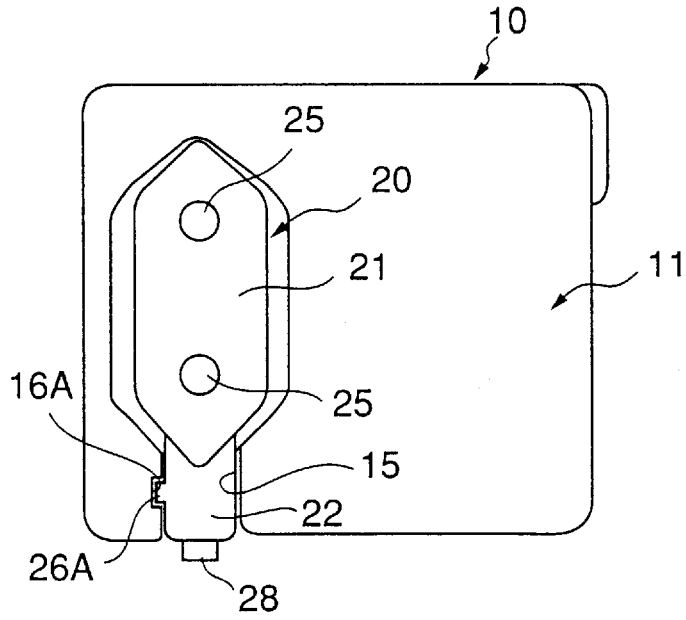
FIG. 7 is a plan view showing a state where the pin configuration adapter of the present invention is attached to the AC-adapter.
Figure 8:
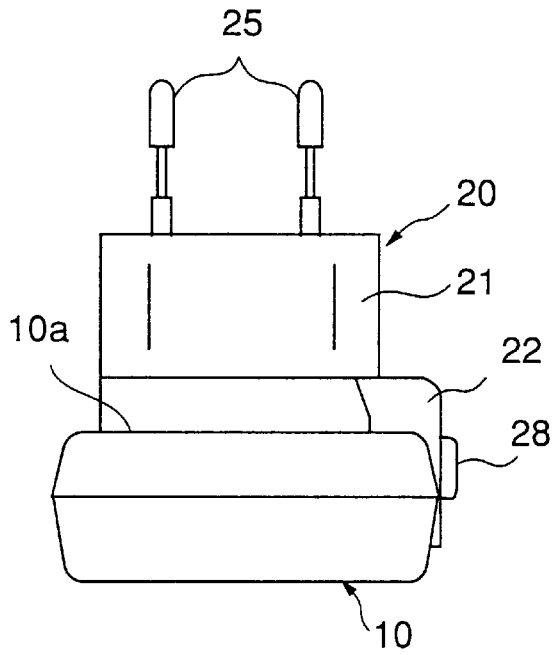
FIG. 8 is a side view showing a state where the pin configuration adapter of the present invention is attached to the AC-adapter.

FIGS. 1 to 9 are diagrams showing a pin configuration adapter for an AC-adapter (hereinafter referred to as a pin configuration adapter) 20 of a first embodiment the present invention. FIG. 1 is a diagram showing how the pin configuration adapter 20 is attached to an AC-adaptor 10. FIGS. 2A to 3B show a configuration of the AC-adapter 10. FIGS. 4A to 5 show a configuration of the pin configuration adapter 20. FIGS. 6 to 8 show a state where the pin configuration adapter 20 is attached to the AC-adapter 10. FIGS. 9A and 9B are diagrams showing a lock mechanism 33 provided in the pin configuration adapter 20.

As shown in FIG. 1, in use, the pin configuration adapter 20 is attached to the AC-adapter 10. Before describing the pin configuration adapter 20 in detail, an explanation will be made of the AC-adapter 10, such as an AC-adapter known from Japanese laid-open patent application No. 11-224717.

As shown in FIGS. 1 to 3B, the AC-adapter 10 generally includes an AC-adapter housing 11, a rotatable plug body 12 and a cord 17. The adaptor housing 11 is a housing made of resin and includes a first housing half-body 11*a* and a second housing half-body 11*b*. The housing half-bodies 11*a* and 11*b* are fixed together to form the AC-adapter housing 11.

Inside the AC-adapter housing 11, there is provided a power transformer circuit (not shown) for converting an alternating current supplied from the rotatable plug body 12 to a direct current of a predetermined voltage. Also, a recess 15 is formed at a predetermined position of the AC-adapter housing 11. The rotatable plug body 12 described below is provided in this recess 15.

Further, the AC-adapter housing 11 is provided with a pair of positioning grooves 16A and 16B extending in a vertical direction in FIG. 1 (in the figure, in the Z1- and Z2-directions shown by an arrow). Although not shown in the figure, a lock hole is provided on a wall of the recess 15. The lock hole receives and engages with the lock mechanism 33 described later.

The rotatable plug body 12 includes a base part 13 and parallel-blade pins 14. The base part 13 is made of insulating resin and can be rotated about a rotational axis in the X1–X2 direction through an angle of approximately 90°. The parallel-blade pins 14 are formed in an integrated manner with the base part 13, for example, by insert molding. Accordingly, when the rotatable plug body 12 rotates about the rotational axis, the parallel-blade pins 14 also rotate about the rotational axis in an integrated manner.

Figure 2C:
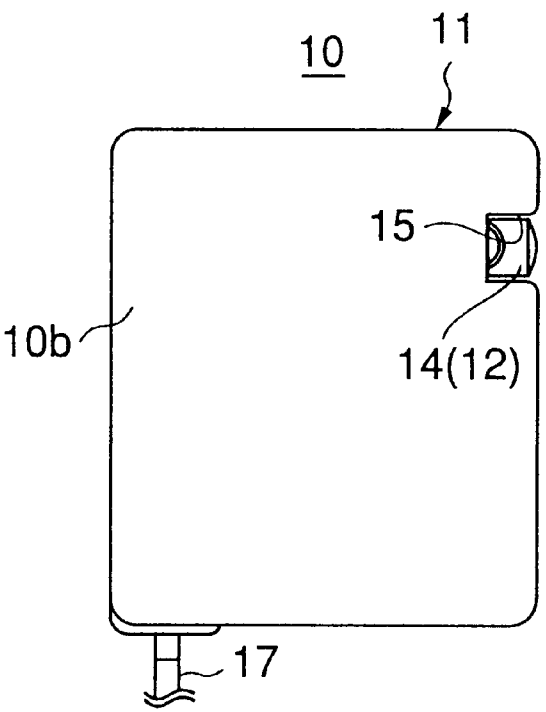
FIGS. 2A to 2C are a plan view, a side view and a bottom view, respectively, of the AC-adapter to which the pin configuration adapter of the embodiment of the present invention is attached, showing a state where a parallel-blade pins are in the accommodated position.
Figure 2B:
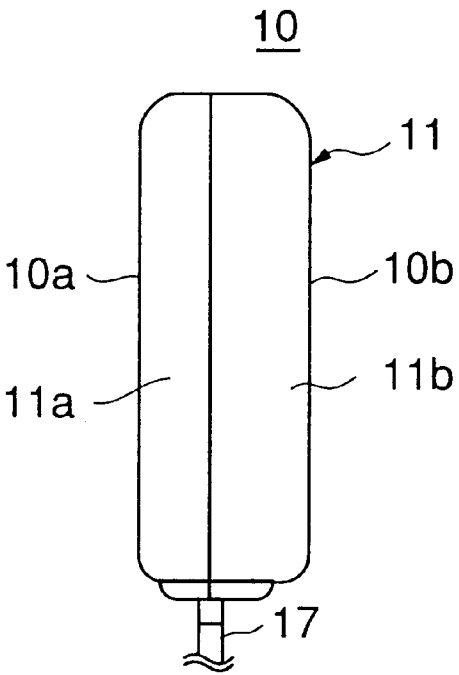
Figure 2A:
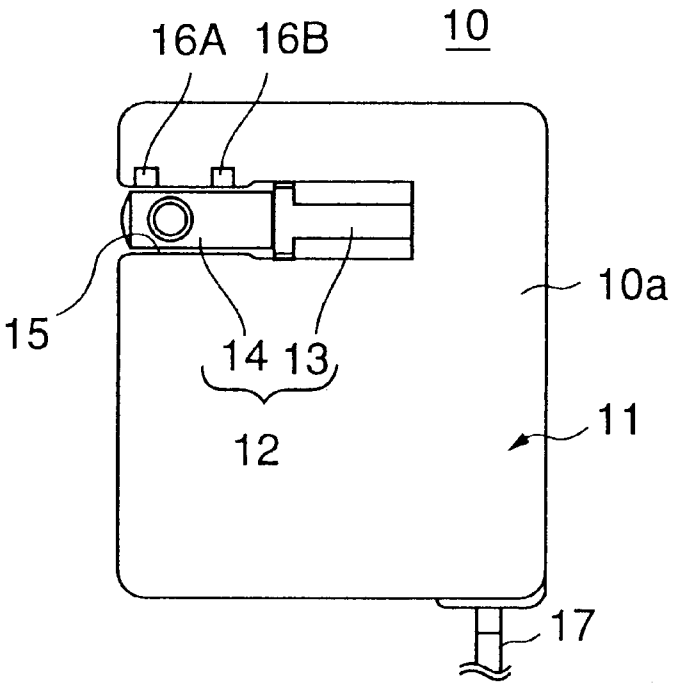
Figure 3B:
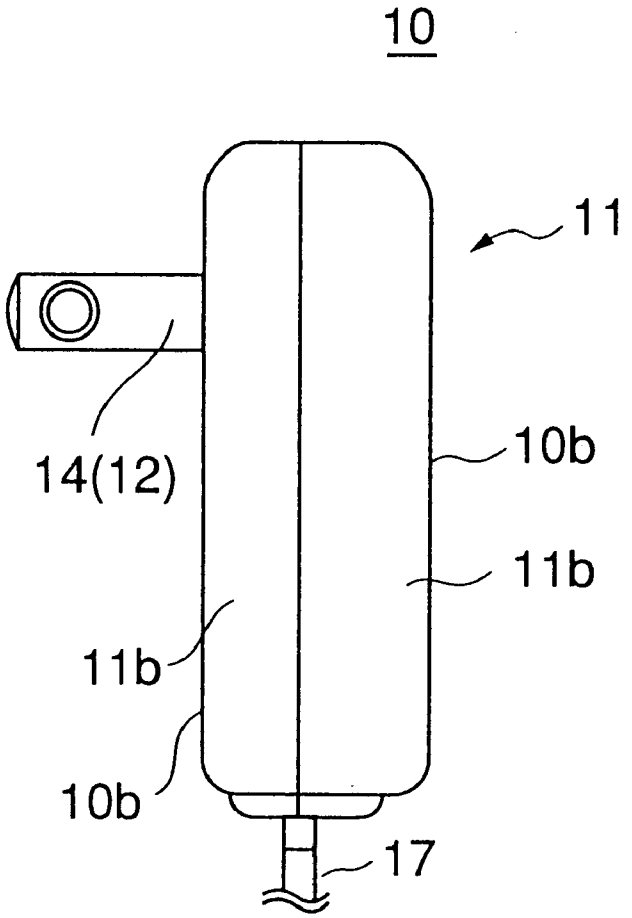
FIG. 3A and 3B are a plan view and a side view, respectively, of the AC-adapter to which the pin configuration adapter of the embodiment of the present invention is attached, showing a state where a parallel-blade pins are in the extruded position.
Figure 3A:
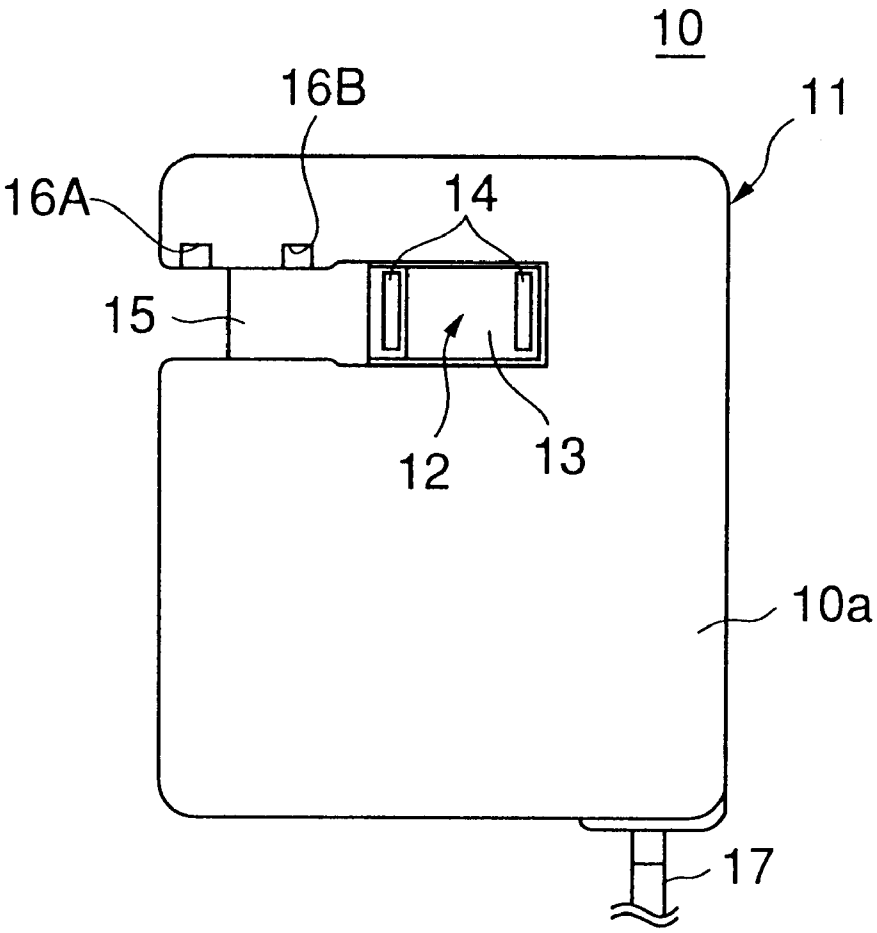

In detail, the rotatable plug body 12 rotates through an angle of approximately 90° between a first position shown in FIGS. 2A to 2C, in which the parallel-blade pins 14 are accommodated in the recess 15, and a second position shown in FIGS. 3A and 3B, in which the parallel-blade pins 14 are substantially perpendicular to the upper surface 10*a* of the AC-adapter housing 11. Also, as shown in FIGS. 3A and 3B, when the rotatable plug body 12 takes the second position, the parallel-blade pins 14 are not accommodated in the recess 15. Therefore, in FIG. 3A, a space appears in the left half of the recess 15, which is not occupied by the base part 13.

Further, the AC-adapter 10 of the present embodiment is configured as follows to achieve an improved security. When the rototational plug body 12 takes the first position (as shown in FIGS. 2A to 2C) the parallel-blade pins 14 and the power supply converting circuits are disconnected. When the rotational plug body 12 takes the second position (as shown in FIGS. 3A and 3B), that is to say only when using the AC-adapter 10, the parallel-blade pins 14 and the power supply conversion circuit are connected.

Now, the configuration of the pin configuration adapter 20 will be described with reference to FIGS. 1, 4A to 4D and 5.

The pin configuration adapter 20 generally includes a pin configuration adapter housing 21, an engaging part 22, round pins 25, and a lock mechanism 33. The pin configuration adapter housing 21 and the engaging part 22 are made by resin molding and in the present embodiment, formed in an integrated manner by molding.

As shown in FIGS. 4B and 4D, the pin configuration adapter housing 21 is provided with a pair of round pins 25 protruding upwards from the upper surface 23. The round pins 25 conforms the European (EU) standard for plugs. Also, a skirt part 29 is provided at the bottom of the pin configuration adapter housing 21, such that an increased contact area is provided with the upper surface 10*a* of the AC-adapter housing 11 when the pin configuration adapter 20 is attached to the AC-adapter 10. Accordingly, the wobbliness of the pin configuration adapter 20 against the AC-adapter housing 11 is reduced.

Also, as shown in FIG. 4C, pin insertion holes 30 are formed on a lower surface 24 of the pin configuration adapter housing 21. In order to plug the pin configuration adapter 20 to the AC-adapter 10, the parallel-blade pins 14 of the AC-adapter 10 are inserted to the pin insertion holes 30.

Now, the internal structure of the pin configuration adapter housing 21 will be described with reference to FIG. 5. FIG. 5 is a partial cutaway diagram of the pin configuration adapter housing 21. As shown in FIG. 5, the round pins 25 are fixed on the pin configuration adapter housing 21 for example by insert molding. The round pins 25 are configured such that connection parts 25A are provided at ends of the round pins 25 in the pin configuration adapter housing 21.

Contacts 31 are provided inside the pin configuration adapter housing 21 at positions opposing the pin insertion holes 30 formed on the lower surface 24. When the parallel-blade pins 14 of the AC-adapter 10 are inserted, the contacts 31 engage with and are electrically connected to the parallel-blade pins 14. Connection parts 31A are provided at upper ends of the contacts 31.

Then, the contact parts 25A formed on the round pins 25 and the contact parts 31A formed on the contacts 31 are electrically connected by connection wires 32. Thus, an electrical connection is established between the round pins 25 and the contacts 31. Thus, when the pin configuration adapter 20 is attached to the AC-adapter 10 and the parallel-blade pins 14 engage with the contacts 31 via the pin insertion holes 30, the parallel-blade pins 14 becomes electrically connected with the round pins 25 via the connection wires 32.

The engaging part 22 extends downwardly from the lower surface of the pin configuration adapter housing 21. The engaging part 22 has a rectangular shape which is configured to match with the recess 15 formed in the AC-adapter 10. In detail, the engaging part 22 is configured to engage in the recess 15, when inserted to the space formed in the recess 15 which appears when the rotational plug body 12 is in the second position.

Also, the engaging part 22 is provided with positioning ribs 26A, 26B and the lock mechanism 33. As shown in FIG. 1, the positioning ribs 26A and 26B extend in the vertical direction (in the Z1- and Z2-directions shown by an arrow). The positioning ribs 26A and 26B are provided at positions corresponding to the position of the positioning grooves 16A and 16B, respectively, formed on the AC-adapter 10.

Therefore, when attaching the pin configuration adapter 20 to the AC-adapter 10, the positioning ribs 26A and 26B are positioned with the positioning grooves 16A and 16B such that the pin configuration adapter 20 and the AC-adapter 10 are positioned with each other. In this state, the parallel-blade pins 14 of the AC-adapter 10 and the pin insertion holes 30 formed on the lower surface 24 of the pin configuration adapter housing 21 are also accurately positioned with each other.

Figure 9A:
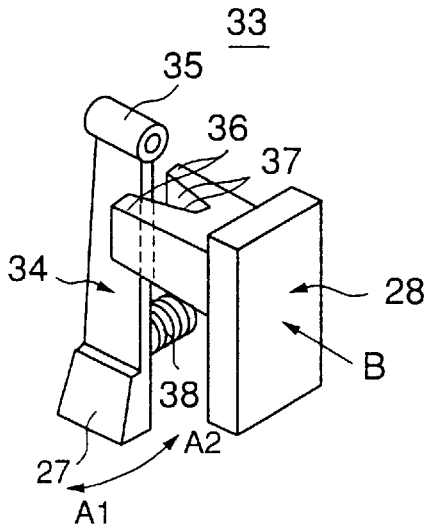
FIGS. 9A and 9B are perspective diagrams showing a lock mechanism provided inside the pin configuration adapter.
Figure 9B:
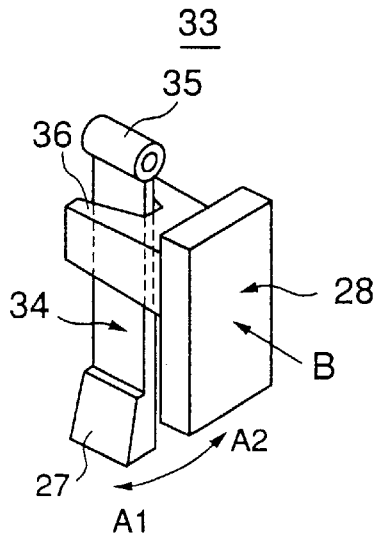

As shown in FIGS. 9A and 9B, the lock mechanism 33 includes a lock release button 28, a lock lever 34 and a coil spring 38. The lock release button 28 can be depressed in the direction shown by an arrow B. Also, the lock release button 28 is provided with a forked lever part 36. The inner surfaces of the forked lever part 36 are formed as tapered surfaces 37. The tapered surfaces 37 are formed such that the separation distance between opposing tapered surfaces 37 increases towards the direction shown by an arrow B.

The lock lever 34 is provided with a pivoting part 35 at its top and the pivoting part 35 is pivotably supported at the engaging part 22. Accordingly, the lock lever 34 is pivotable in the A1- and A2-directions shown by an arrow. Also, a lock pawl 27 is provided at the lower end of the lock lever 34, such that it can be protruded outside from an opening 39 (see FIGS. 1 and 4B) formed on the engaging part 22.

Further, the coil spring 38 is provided on a back side (opposite side of the side provided with the lock pawl 27) of the lock lever 34. The coil spring 38 pivots and biases the lock lever 34 in the A1-direction shown by an arrow. Therefore, when the lock release button 28 is not in a depressed state, the lock pawl 27 formed on the lock lever 34 protrudes from the engaging part 22 (a state shown in FIG. 9A).

The above-mentioned lock release button 28 is provided on the side part of the lock lever 34. In detail, the side part of the lock lever 34 is provided so as to oppose the pair of tapered surfaces 37 formed on the forked lever part 36. Therefore, when the lock release button 28 is depressed in the direction shown by an arrow B, the tapered surfaces 37 engages with the lock lever 34 and the lock lever 34 will be displaced in the A2-direction shown by an arrow (a state shown in FIG. 9B). In accordance with the movement of the lock lever 34, the lock pawl 27 is also displaced in the A1-direction shown by an arrow. Thus, the lock pawl 27 becomes substantially flush with the surface of the engaging part 22.

Now, an operation of attaching the above-described pin configuration adapter 20 to the AC-adapter 10 will be described.

In order to attach the pin configuration adapter 20 to the AC-adapter 10, as shown in FIG. 1, the positioning ribs 26A and 26B provided on the pin configuration adapter 20 are positioned with the positioning grooves 16A and 16B such that the positioning ribs 26A and 26B engage wit the positioning grooves 16A and 16B. Accordingly, the pin configuration adapter 20 and the AC-adapter 10 can be properly positioned against each other. Also, in this state, the parallel-blade pins 14 of the AC-adapter 10 and the pin insertion holes 30 formed onto lower surface 24 of the pin configuration adapter housing 21 are accurately positioned.

Therefore, as the positioning ribs 26A and 26B are inserted into the positioning grooves 16A and 16B, the engaging part 22 is inserted into the recess 15 and the parallel-blade pins 14 is be inserted in the pin insertion holes 30. Thus, an attachment process of the pin configuration adapter to the AC-adapter can be implemented easily.

Also, when the engaging part 22 is inserted into the recess 15, the lock pawl 27 of the lock mechanism 33 comes in contact with the inner surface of the recess 15. Therefore, the lock pawl 27 is retracted in the A2-direction against the elastic force of the coil spring 38. Then, when the lock pawl 27 comes to a position opposing a lock hole (not shown in the figure) formed in the recessed part 15, the lock pawl 27 again comes to a state where it is protruded from the engaging part 22. That is to say, the lock pawl 27 comes to a state where it is engaged with the AC-adapter housing 11.

Accordingly, the pin configuration adapter 20 is locked to the AC-adapter 10 by means of the lock mechanism 33 and the pin configuration adapter 20 is prevented from being detached from the AC-adapter 10. Thus, the pin configuration adapter 20 comes to a state where it is attached to the AC-adapter 10. FIGS. 6 to 8 are diagrams showing states where the pin configuration adapter 20 is attached to the AC-adapter 10.

In such a state where the pin configuration adapter 20 is attached to the AC-adapter 10, the parallel-blade pins (first plug) 14 are inserted to the pin configuration adapter housing 21 of the pin configuration adapter 20 via the pin insertion holes 30. Thus, the parallel-blade pins 14 engages and thus is electrically connected with the contacts 31, and can be electrically connected to the round pins (second plug) 25 via the connection wires 32. Therefore, when the pin configuration adapter 20 is attached, the AC-adapter 10 can be used in those countries adopting the round pins 25 as a standard.

Also, when the pin configuration adapter 20 is attached to the AC-adapter 10, the parallel-blade pins 14 engage with the contacts 31 and the engaging part 22 engages with the recess 15. Therefore, the pin configuration adapter 20 is attached to the AC-adapter 10 by two forces: an engagement force between the parallel-blade pins 14 and the contacts 31 and an engagement force between the engaging part 22 and the recess 15. Thus, since the pin configuration adapter 20 is attached to the AC-adapter 10 by two engagement forces, the pin configuration adapter 20 can be securely attached to the AC-adapter 10 and thus does not easily detach from the AC-adapter 10.

Further, in the present embodiment, the lock mechanism 3 is provided as described above such that the lock pawl 27 engages with the lock hole of the recess 15 in a state where the pin configuration adapter 20 is attached to the AC-adapter 10. Therefore, when the engagement part 22 engages with the recess 15, the engaging part 22 and the recess 15 (AC-adapter housing 11) can be more securely fastened. Thus, the pin configuration adapter 20 can be prevented from being detached from the AC-adapter 10.

Further, as has been described above, the engaging part 22 engages with the recess 15 formed on the AC-adapter 10. The recess 15 is essentially a portion where the parallel-blade pins 14 are accommodated and therefore it is initially formed in the AC-adapter 10. The present embodiment uses the fact that a space is made in the recess 15 when the parallel-blade pins 14 moves to the second position (when the AC-adapter 10 is in use). The engaging part 22 is configured such that it can be inserted in the space in the recess 15.

Therefore, even in a state where the engaging part 22 is engaged with the recess 15 of the AC-adapter 10, the size of the AC-adapter 10 is kept considerably compact. Also, even when the pin configuration adapter 20 is attached to the AC-adapter 10, the portableness of the AC-adapter 10 is maintained.

On the other hand, the pin configuration adapter 20 can be detached from the AC-adapter 10 by releasing the lock pawl 27 and the lock hole by depressing the lock release button 28, and pulling the pin configuration adapter 20 off from the AC-adapter 10.

Figure 10A:
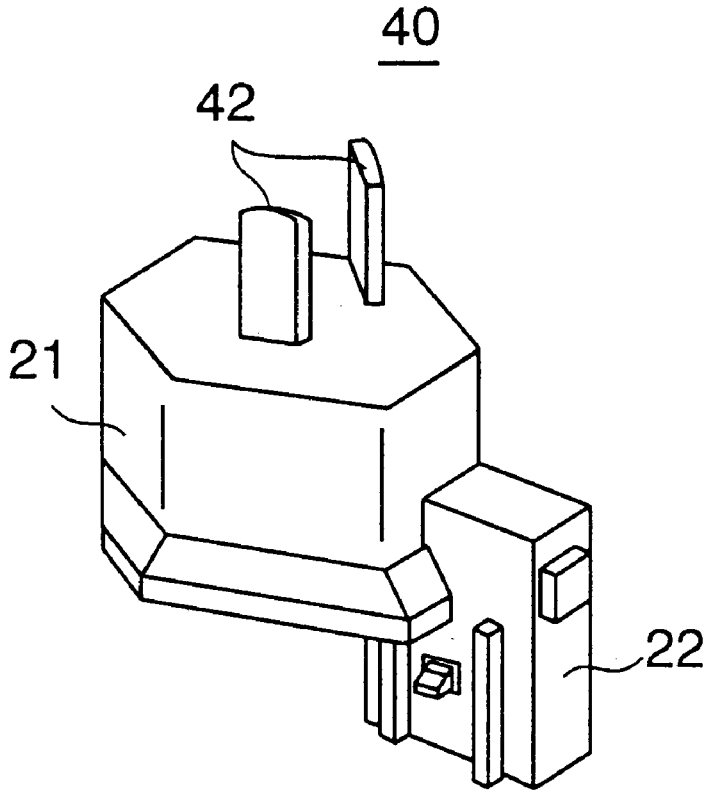
FIGS. 10A and 10B are perspective diagrams showing pin configuration adapters of the variants of the present invention.
Figure 10B:
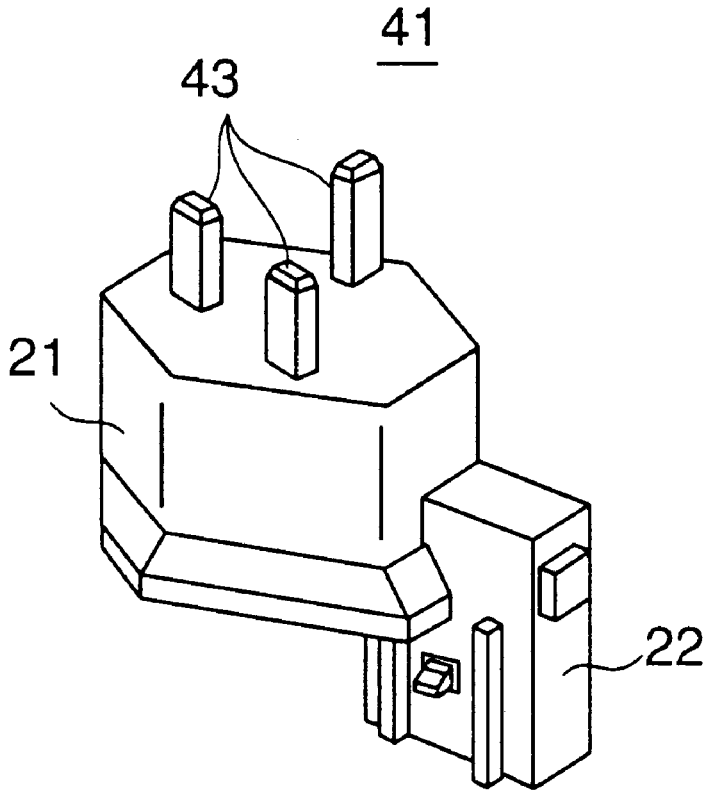

"It is to be noted that the above embodiment has been described using the round pins 25 as an example of the pins provided on the pin configuration adapter 20. However, as shown in FIGS. 10A and 10B, the pin configuration adapter 20 may be altered to configurations conforming the standards for various countries adopting a different pin configuration than, for example, the round pins 25 by providing pins of various types on the pin configuration adapter housing 21. FIG. 10A is a variant of a pin configuration adapter 40 in which non-parallel blade pins 42 are provided. FIG. 10B is a variant of a pin configuration adapter 41 in which 3-terminal pins are provided."

Further, the present invention is not limited to these embodiments, and variations and modifications may be made without departing from the scope of the present invention.

The present application is based on Japanese priority application No. 2000-391427 filed on Dec. 22, 2000, the entire contents of which are hereby incorporated by reference.

What is claimed is:

1. A pin configuration adapter attachable to an AC-adaptor having a rotatable plug body having pins for transferring an electric power, said pins being in a first pin configuration, and an AC-adapter housing having a recess for accommodating said rotatable plug body rotated into said recess and also having a conversion circuit for converting an electric power received from said rotatable plug body, wherein said rotatable plug body is in a first position when said pins of said plug body is accommodated in said recess of said AC-adapter housing and in a second position when said pins of said plus body is rotated out of said recess in an upright position with respect to said AC-adapter housing, said pin configuration adapter comprising:

a plug part hating pins in a second pin configuration different from said first pin configuration of said plug body of said AC-adapter, a receptacle part, which is electrically connected to said plug part, for receiving said pins of said rotatable plug body in said first pin configuration when said rotatable plug body is in said second position, wherein the plug body pins in said second position extend in the same direction as the plug part pins and are electrically connected to said conversion circuit of said AC adapter whereas the plug body pins in said first position are not electrically connected to said conversion circuit of said AC adapter; and an engaging part attached to a side of said receptacle part, for engagement into said recess of said AC-adapter housing formed when said plug body is rotated in said second position in said recess.

2. The pin configuration adapter as claimed in claim 1, wherein said engaging part comprises a lock mechanism for locking said engaging part engaged in said recess of said AC-adaptor housing.

3. The pin configuration adapter as claimed in claim 1, wherein said engaging part comprises positioning ribs which mate with positioning grooves fanned in said recess of said AC-adapter housing.

4. An electrical connector assembly having an AC-adaptor housing and a pin configuration adapter, said AC-adapter housing having a recess formed therein comprising:

a plug body having pins in a first pin configuration and a conversion circuit for converting an electric power received from said plus body, wherein said plug body is rotatable between a first position in which position said plug body is accommodated in said recess and a second position in which position said plug body is out of said recess in an upright position with respect to said AC-adapter housing; and said pin configuration adapter comprising:

a plug part having pins in a second pin configuration different from said first pin configuration of said plug body of said AC-adaptor housing;

a receptacle part, which is electrically connected to said plug part, for receiving said pins of said plug body of first pin configuration when said plug body is in said second position, wherein the plug body pins in said second position extend in the same direction as the plug part pins and ate electrically connected to said conversion circuit of said AC adapter whereas the plug body pins in said first position are not electrically connected to said conversion circuit of said AC adapter; and an engaging park attached to a side of said receptacle part, for engagement into said recess of said AC-adapter housing formed when said plug body is rotated in said second position in said recess.

* * * * *